US006220530B1

(12) United States Patent
Wu

(10) Patent No.: US 6,220,530 B1
(45) Date of Patent: Apr. 24, 2001

(54) WATER SPRAY NOZZLE CONTROL DEVICE

(76) Inventor: Sheng-Li Wu, 58, Ma Yuan West St., Taichung (TW)

( * ) Notice: Subject to any disclaimer, the term of this patent is extended or adjusted under 35 U.S.C. 154(b) by 0 days.

(21) Appl. No.: 09/431,118

(22) Filed: Nov. 1, 1999

(51) Int. Cl.[7] ..... B05B 1/30

(52) U.S. Cl. ..... 239/583; 239/569; 239/525; 251/347; 251/251; 74/107; 74/110

(58) Field of Search ..... 239/525, 530, 239/569, 579, 581.1, 583; 251/251, 347; 74/107, 110

(56) References Cited

U.S. PATENT DOCUMENTS

| | | | | |
|---|---|---|---|---|
| 174,781 | * | 3/1876 | Clemens | 251/347 X |
| 278,008 | * | 5/1883 | Haley | 251/251 X |
| 1,496,338 | * | 6/1924 | Haley | 239/583 X |
| 2,089,279 | * | 8/1937 | Loeffler | 74/110 X |
| 2,953,344 | * | 9/1960 | Yancey | 251/251 X |
| 3,210,013 | * | 10/1965 | Symmons | 74/107 X |
| 3,784,113 | * | 1/1974 | Specht | 239/583 X |
| 4,930,704 | * | 6/1990 | Chen | 251/251 X |
| 5,704,397 | * | 1/1998 | Lu | 239/583 X |
| 5,918,811 | * | 7/1999 | Denham et al. | 251/347 X |

* cited by examiner

*Primary Examiner*—Andres Kashnikow
*Assistant Examiner*—Steven J. Ganey

(57) ABSTRACT

A water spray nozzle control device has a main body, a rotatable collar, a positioning shaft, a water check collar, a plunger, a water sieve device, and a water stopping washer. The main body has a channel, a hollow threaded head, a handle, and a neck disposed between the handle and the hollow threaded head. The channel receives the water check collar, the plunger, the water sieve device, and the water stopping washer. The hollow threaded head engages with a water spray nozzle. The neck has a through hole receiving the positioning shaft. The rotatable collar encloses the neck.

1 Claim, 5 Drawing Sheets

WATER SPRAY NOZZLE CONTROL DEVICE

BACKGROUND OF THE INVENTION

The present invention relates to a water spray nozzle control device More particularly, the present invention relates to a water spray nozzle control device which can adjust an amount of flowing water.

A conventional water spray nozzle control device is used as a switch. The conventional water spray nozzle control device can turn on a water flow which flows into a water spray nozzle or turn off the water folw. However, the amount of flowing water cannot be adjusted by the conventional water spray nozzle control device.

SUMMARY OF THE INVENTION

An object of the present invention is to provide a water spray nozzle control device which can adjust an amount of water flowing into a water spray nozzle.

Another object of the present invention is to provide a water spray nozzle control device which has a positioning block engaging with a plurality of inner teeth in order to control a flowing amount of water.

Accordingly, a water spray nozzle control device comprises a main body, a rotatable collar, a positioning shaft, a water check collar, a plunger, a water sieve device, and a water stopping washer. The main body has a channel, a hollow threaded head, a handle, and a neck disposed between the handle and the hollow threaded head. The channel receives the water check collar, the plunger, the water sieve device, and the water stopping washer. The neck has a through hole receiving the positioning shaft. The rotatable collar has a plurality of inner teeth and two eccentric inner grooves. The rotatable collar encloses the neck. The handle has an outer flange, a front inner stepped flange, a rear inner stepped flange, an inner threaded end portion, and a plurality of anti-skid ribs. The front inner stepped flange blocks the water check collar. The rear inner stepped flange blocks the water stopping washer. A positioning block is disposed on the outer flange of the handle. The positioning shaft has a first distal end, an annular groove, a center camber, an annular recess, and a second distal end. A water stopping gasket is inserted in the annular groove. An annular gasket is inserted in the annular recess. The water check collar has an inner bevel, a round hole, and an enlarged circular hole communicating with the round hole. The plunger has a through aperture, a hollow cylinder, a tube disposed on a top end of the hollow cylinder, an outer bevel formed on a top portion of the hollow cylinder, and four wing plates disposed on the hollow cylinder. The tube is inserted through the round hole of the water check collar. The hollow cylinder is inserted in the enlarged circular hole of the water check collar. The water sieve device has a disk seat and four positioning plates. A plurality of sieve meshes are formed on the disk seat. The eccentric inner grooves of the rotatable collar receive the first distal end and the second distal end of the positioning shaft. When the rotatable collar is rotated to a close position, the rotatable collar forces the first distal end and the second distal end of the positioning shaft to move downward. The outer bevel of the plunger engages with the inner bevel of the water check collar. The positioning block engages with one of the inner teeth. When the rotatable collar is rotated to an open position, the rotatable collar forces the first distal end and the second distal end of the positioning shaft to move upward. The center camber of the positioning shaft blocks the tube. A spacing is formed between the outer bevel of the plunger and the inner bevel of the water check collar. The positioning block engages with one of the inner teeth.

DETAILED DESCRIPTION OF THE INVENTION

Figure 1:
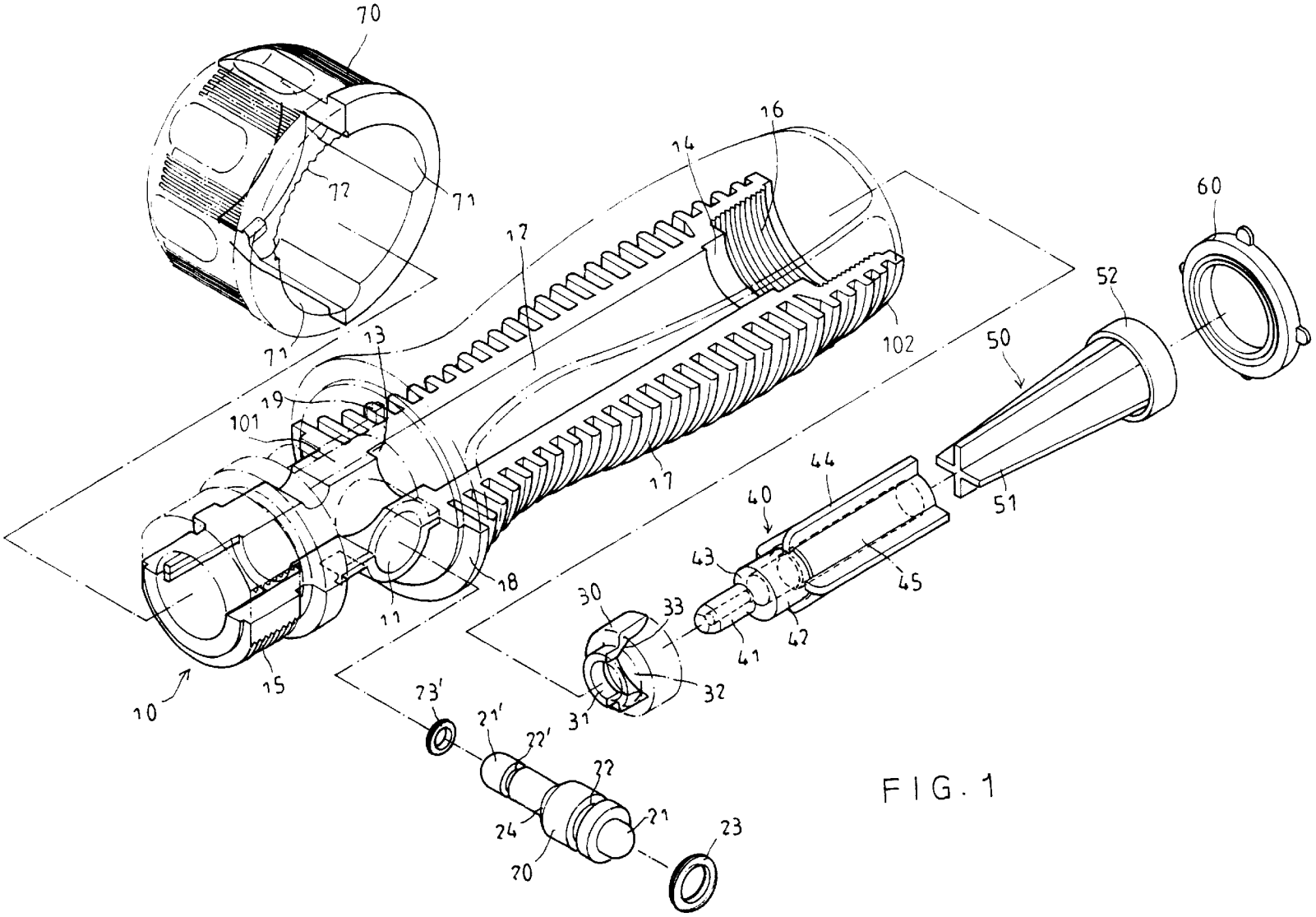
FIG. 1 is a perspective exploded view of a water spray nozzle control device of a preferred embodiment in accordance with the present invention.
Figure 1A:
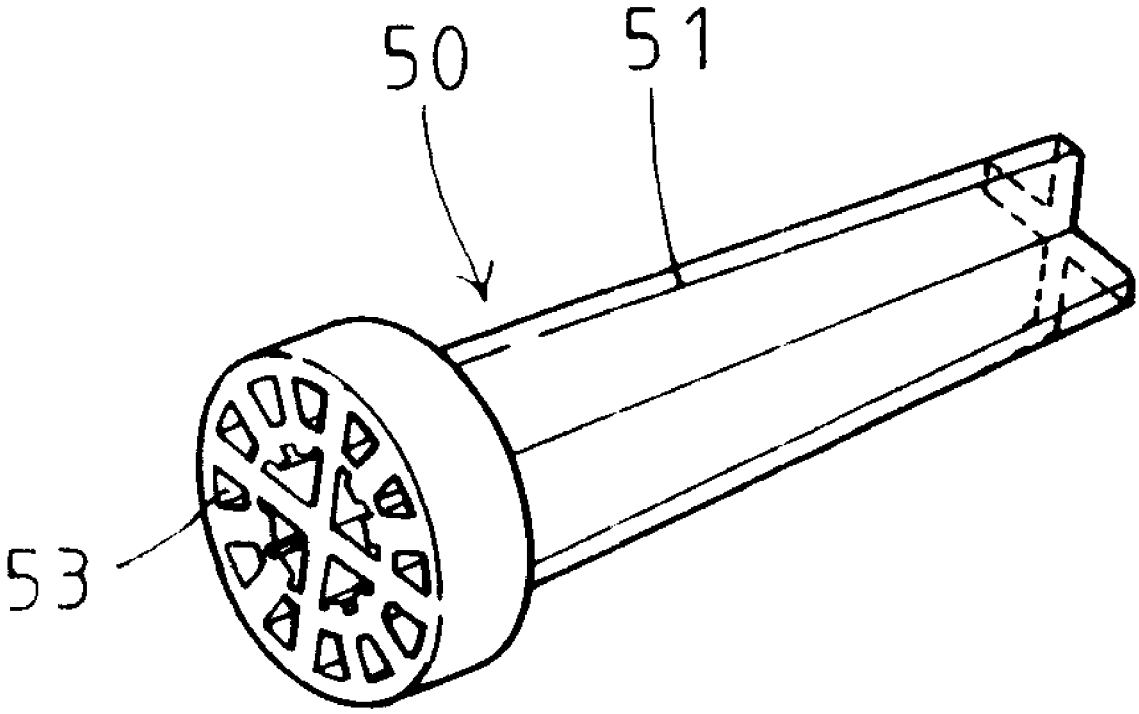
FIG. 1A is a perspective exploded view of a water sieve device of a preferred embodiment in accordance with the present invention.
Figure 2:
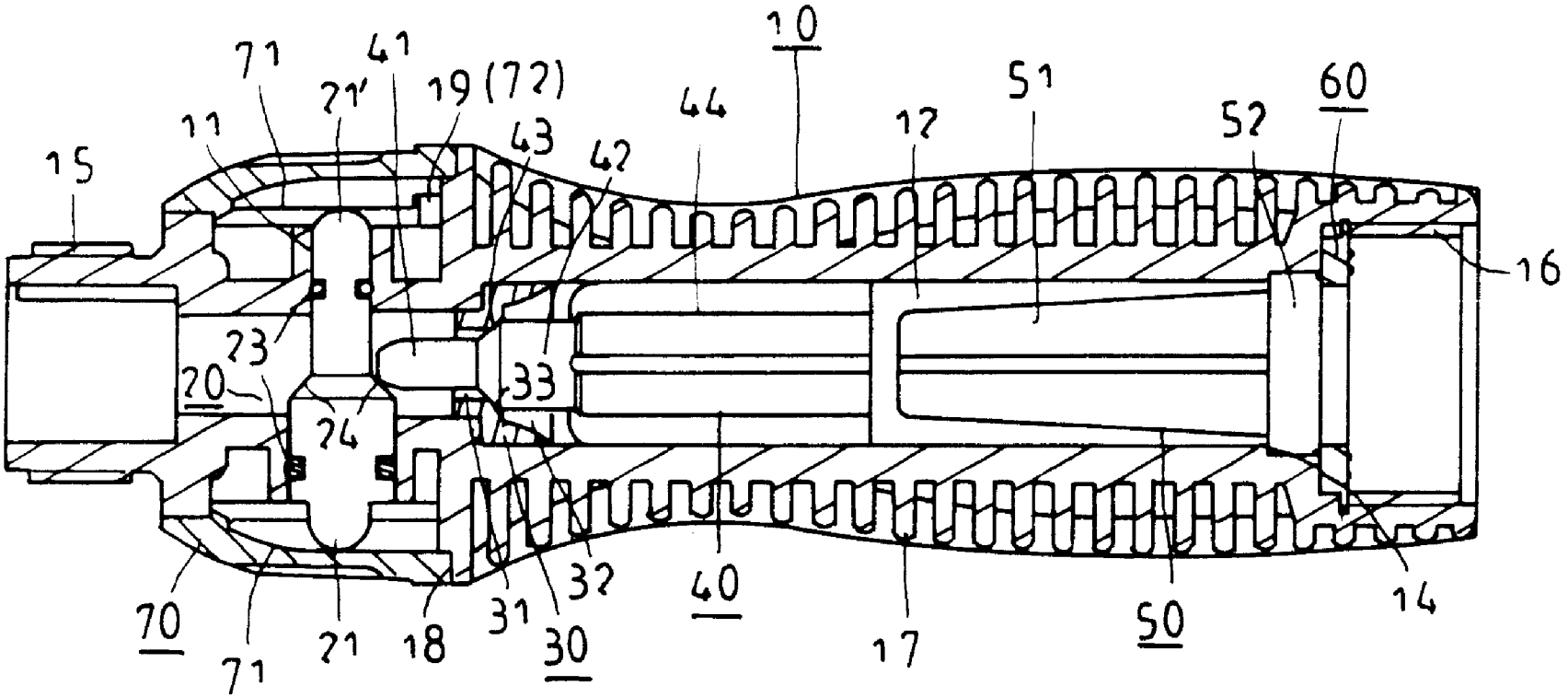
FIG. 2 is a sectional assembly view of a water spray nozzle control device of a preferred embodiment while water is stopped.

Referring to FIGS. 1, 1A and 2, a water spray nozzle control device comprises a main body 10, a rotatable collar 70, a positioning shaft 20, a water check collar 30, a plunger 40, a water sieve device 50, and a water stopping washer 60.

The main body 10 has a channel 12, a hollow threaded head 15, a handle 102, and a neck 101 disposed between the handle 102 and the hollow threaded head 15. The channel 12 receives the water check collar 30, the plunger 40, the water sieve device 50, and the water stopping washer 60.

The hollow threaded head 15 engages with a water spray nozzle (not shown in the figures).

The neck 101 has a through hole 11 receiving the positioning shaft 20.

The rotatable collar 70 has a plurality of inner teeth 72 and two eccentric inner grooves 71. The rotatable collar 70 encloses the neck 101.

The handle 102 has an outer flange 18, a front inner stepped flange 13, a rear inner stepped flange 14, an inner threaded end portion 16, and a plurality of anti-skid ribs 17.

The front inner stepped flange 13 blocks the water check collar 30. The rear inner stepped flange 14 blocks the water stopping washer 60.

The inner threaded end portion 16 engages with a water pipe (not shown in the figures).

A positioning block 19 is disposed on the outer flange 18 of the handle 102.

The positioning shaft 20 has a first distal end 21, an annular groove 22, a center camber 24, an annular recess 22', and a second distal end 21'.

A water stopping gasket 23 is inserted in the annular groove 22. An annular gasket 23' is inserted in the annular recess 22'.

The water check collar 30 has an inner bevel 33, a round hole 31, and an enlarged circular hole 32 communicating with the round hole 31.

The plunger 40 has a through aperture 45, a hollow cylinder 42, a tube 41 disposed on a top end of the hollow cylinder 42, an outer bevel 43 formed on a top portion of the hollow cylinder 42, and four wing plates 44 disposed on the hollow cylinder 42.

The tube 41 is inserted through the round hole 31 of the water check collar 30. The hollow cylinder 42 is inserted in the enlarged circular hole 32 of the water check collar 30.

The water sieve device 50 has a disk seat 52 and four positioning plates 51. A plurality of sieve meshes 53 are formed on the disk seat 52.

The eccentric inner grooves 71 of the rotatable collar 70 receive the first distal end 21 and the second distal end 21' of the positioning shaft 20.

Figure 4:
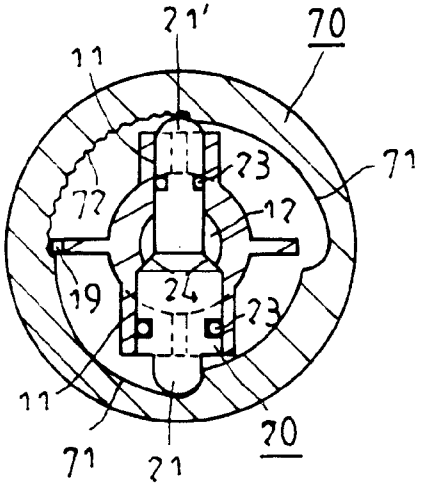
FIG. 4 is another sectional assembly view of a water spray nozzle control device of a preferred embodiment while water is stopped.

Referring to FIGS. 2 and 4, the rotatable collar 70 is rotated to a close position. The rotatable collar 70 forces the first distal end 21 and the second distal end 21' of the positioning shaft 20 to move downward. The outer bevel 43 of the plunger 40 engages with the inner bevel 33 of the water check collar 30. The positioning block 19 engages with one of the inner teeth 72.

Figure 3:
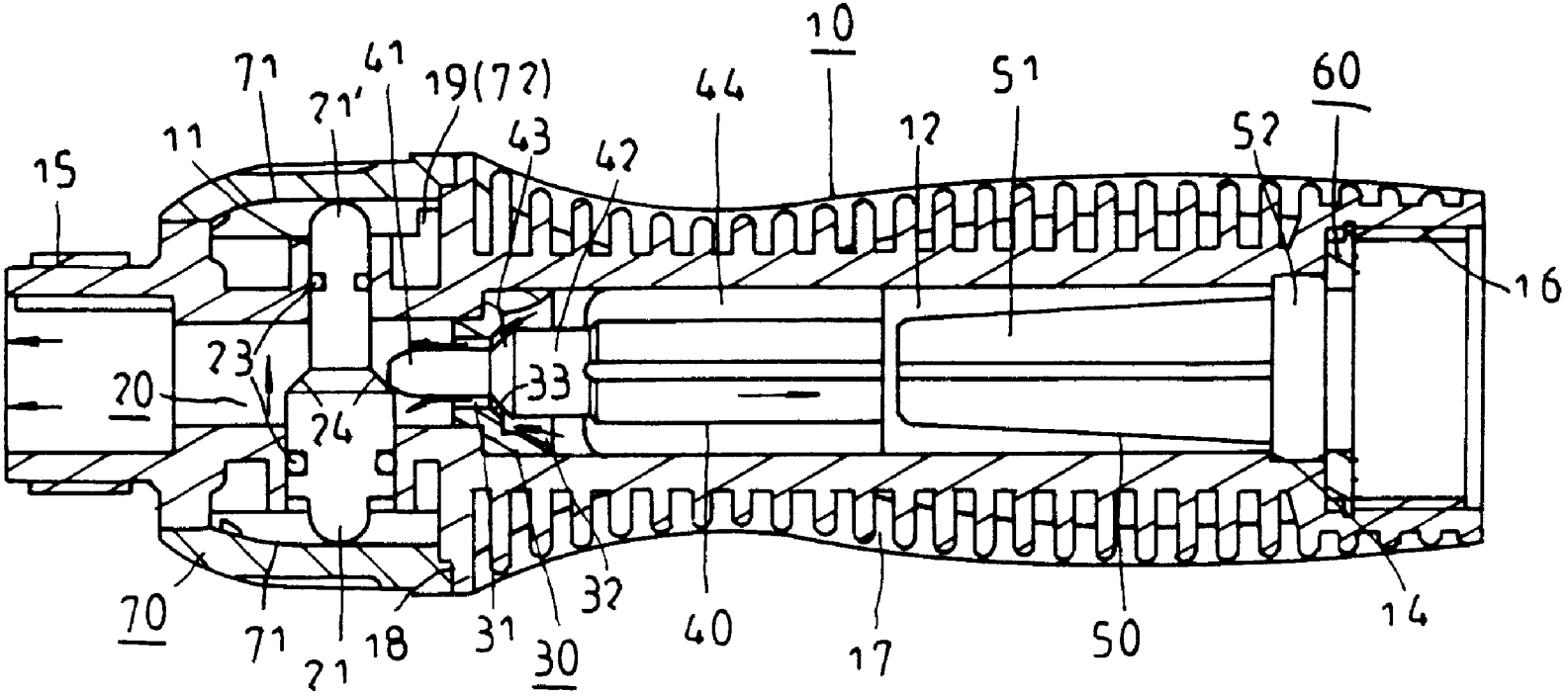
FIG. 3 is a sectional assembly view of a water spray nozzle control device of a preferred embodiment while water is flowing out.
Figure 5:
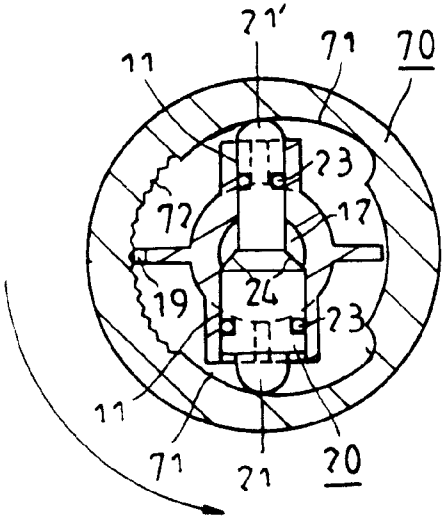
FIG. 5 is another sectional assembly view of a water spray nozzle control device of a preferred embodiment while water is flowing out.

Referring to FIGS. 3 and 5, the rotatable collar 70 is rotated to an open position. The rotatable collar 70 forces the first distal end 21 and the second distal end 21' of the positioning shaft 20 to move upward. The center camber 24 of the positioning shaft 20 blocks the tube 41. A spacing is formed between the outer bevel 43 of the plunger 40 and the inner bevel 33 of the water check collar 30. The positioning block 19 engages with one of the inner teeth 72. Therefore, the amount of flowing water is adjusted by the water spray nozzle control device.

The invention is not limited to the above embodiment but various modification thereof may be made. Further, various changes in form and detail may be made without departing from the scope of the invention.

I claim:

1. A water spray nozzle control device comprises:

a main body, a rotatable collar, a positioning shaft, a water check collar, a plunger, a water sieve device, and a water stopping washer, the main body having a channel, a hollow threaded head, a handle, and a neck disposed between the handle and the hollow threaded head, the channel receiving the water check collar, the plunger, the water sieve device, and the water stopping washer, the neck having a through hole receiving the positioning shaft, the rotatable collar having a plurality of inner teeth and two eccentric inner grooves, the rotatable collar enclosing the neck, the handle having an outer flange, a front inner stepped flange, a rear inner stepped flange, an inner threaded end portion, and a plurality of anti-skid ribs, the front inner stepped flange blocking the water check collar, the rear inner stepped flange blocking the water stopping washer, a positioning block disposed on the outer flange of the handle, the positioning shaft having a first distal end, an annular groove, a center camber, an annular recess, and a second distal end, a water stopping gasket inserted in the annular groove, an annular gasket inserted in the annular recess, the water check collar having an inner bevel, a round hole, and an enlarged circular hole communicating with the round hole, the plunger having a through aperture, a hollow cylinder, a tube disposed on a top end of the hollow cylinder, an outer bevel formed on a top portion of the hollow cylinder, and four wing plates disposed on the hollow cylinder, the tube inserted through the round hole of the water check collar, the hollow cylinder inserted in the enlarged circular hole of the water check collar, the water sieve device having a disk seat and four positioning plates, a plurality of sieve meshes formed on the disk seat, the eccentric inner grooves of the rotatable collar receiving the first distal end and the second distal end of the positioning shaft, when the rotatable collar is rotated to a close position, the rotatable collar forces the first distal end and the second distal end of the positioning shaft to move downward, the outer bevel of the plunger engages with the inner bevel of the water check collar, and the positioning block engages with one of the inner teeth, when the rotatable collar is rotated to an open position, the rotatable collar forces the first distal end and the second distal end of the positioning shaft to move upward, the center camber of the positioning shaft blocks the tube, a spacing is formed between the outer bevel of the plunger and the inner bevel of the water check collar, and the positioning block engages with one of the inner teeth.

* * * * *